United States Patent [19]

Hill

[11] Patent Number: 4,622,463

[45] Date of Patent: Nov. 11, 1986

[54] TWO-PULSE TRACER EJECTION METHOD FOR DETERMINING INJECTION PROFILES IN WELLS

[75] Inventor: Alfred D. Hill, Austin, Tex.

[73] Assignee: Board of Regents, University of Texas System, Austin, Tex.

[21] Appl. No.: 532,160

[22] Filed: Sep. 14, 1983

[51] Int. Cl.[4] ..... G01V 5/04

[52] U.S. Cl. ..... 250/259; 250/260

[58] Field of Search ..... 250/259, 260, 303, 356.1, 250/356.2; 166/252, 64; 175/42, 48; 73/155

[56] References Cited

U.S. PATENT DOCUMENTS

| | | | |
|---|---|---|---|
| 3,255,347 | 6/1966 | Cobb | 250/260 |
| 3,590,923 | 7/1971 | Cooke | 166/252 |
| 3,902,362 | 9/1975 | Tomich | 73/155 |
| 4,055,399 | 10/1977 | Parrish | 250/259 |
| 4,168,746 | 9/1979 | Sheely | 166/252 |
| 4,196,619 | 4/1980 | Collins | 73/155 |

OTHER PUBLICATIONS

A Primer on Radioactive Tracer Injection Profiling, by Gunter J. Litchtenberger, Sun Production Company.

*Primary Examiner*—Carolyn E. Fields

*Attorney, Agent, or Firm*—Arnold, White & Durkee

[57] ABSTRACT

In a method of radioactive tracer logging, two slugs of tracer material are ejected. The slugs are ejected either sequentially from a single location or simultaneously from two spaced-apart locations. The distance between the tracer slugs is measured by moving a detector through the tracer slugs as they move down the borehole. The distance between the two slugs of tracer material are repeatedly measured as a function of depth, and from the measurements the amount of fluid exiting the wellbore is calculated to provide an injection profile of the well.

10 Claims, 3 Drawing Figures

TWO-PULSE TRACER EJECTION METHOD FOR DETERMINING INJECTION PROFILES IN WELLS

BACKGROUND OF THE INVENTION

The present invention relates to production logging systems for use in the oil and gas industry; more particularly, it relates to a method and apparatus for conducting radioactive tracer logging to determine the injection profile of a well.

To enhance hydrocarbon production, fluids are often injected into a subterranean formation to urge hydrocarbons to producing wells. Such operations are referred to as "secondary" or "tertiary" recovery techniques. Wellbores into which the fluids are injected are referred to as "injection wells". Optimization of fluid injection recovery techniques requires that the fluids be injected at depths where formation permeability is greatest. Accordingly, a profile of the depth locations and relative quantities of fluid exiting the injection wellbore, referred to as a "injection profile", is advantageous. Radioactive tracer logs are commonly used to determine the injection profile in water injection wells.

In radioactive tracer logging, a small quantity of radioactive material is dissolved in a carrier and injected downhole into the fluids flowing in the tubing or casing. The distribution of the radioactive tracer is monitored by a gamma ray detector. There are primarily two radioactive tracer logging methods in use for determining injection profiles. These methods are the velocity shot method and the tracer loss method.

In the velocity shot method, a single slug of tracer material is ejected from a downhole logging tool. Two gamma ray detectors mounted on the tool and spaced a discrete distance apart measure the passage of the tracer slug. The velocity in the wellbore at a particular location is determined from the transit time of the radioactive tracer between the two detectors. The accuracy of the velocity shot method is based on the assumption that the velocity is constant betwen the two detectors. The assumption is not valid, however, if the tool is opposite a part of the formation that is receiving injected fluid or if the wellbore diameter is not constant. The fallacy of the basic assumptions produces errors in the injection profile.

The tracer loss method involves injecting a single slug of tracer material into the wellbore at a location above all fluid injection. The tracer slug is followed as it progresses down the borehole by repeatedly passing through the tracer slug a gamma ray detector mounted on the logging tool. The repeated detection yields a series of plots of tracer concentration verses depth. The tracer loss method assumes that the decrease in total amount of tracer in the wellbore is proportional to the amount of fluid exiting the wellbore above the measurement location. However, since gamma rays are able to penetrate into a formation, at least some of the gamma ray signal assumed to be due to tracer in the wellbore may be originating from tracer material that has entered the formation. Additionally, there is significant dispersion of the tracer slug such that the depth locations of fluid loss to the formation cannot be accurately ascertained.

Other radioactive tracer logging techniques have been proposed. For example, U.S. Pat. No. 3,590,923 to Cooke, Jr. discloses a method in which two tracers of different partition coefficients are injected into a formation. The degree of separation is measured to determine fluid saturations. The method is based on chromatographic analytical techniques. Similarly U.S Pat. No. 4,168,746 to Sheely teaches to inject a plurality of tracers at different partition coefficients at different distances into a formation for evaluation of surfactant flood. This method is also a chromatographic technique. Finally, U.S. Pat. No. 4,055,399 to Parrish discloses a method for testing formation velocity in which a different one of a plurality of different tracers is added to each of a number of fluid slugs. At least two of the tracers are added in different pre-selected ratios, and an analysis is made of recovered fluid to measure the content of each of the tracers and thereby determine which of the fluid slugs produced the recovered fluid.

The present invention provides an improved radioactive tracer logging method which is more accurate than methods heretofore used.

BRIEF DESCRIPTION OF THE DRAWINGS

A written description setting forth the best mode presently known for carrying out the present invention, and of the manner of implementing and using it, is provided by the following detailed description which references the attached drawings wherein.

DETAILED DESCRIPTION OF THE INVENTION

In radioactive tracer logging in accordance with the present invention, carrier fluid is introduced into an injection wellbore. The fluid is preferably water; but, gases can also be used, such as methane, propane and carbon dioxide. Two discrete slugs of tracer material are injected into the carrier fluid at a location above any point of fluid exit from the wellbore. Injection of the tracer slugs into the carrier fluid is by a logging tool having tracer ejection means. A suitable material for use as a tracer is a solution of a radioactive iodine compound in an appropriate solvent to assure proper dissolution in the carrier fluid. Typical examples would be sodium iodide in water for water injection and methyl or ethyl iodide for gas injection.

The tracer ejection means preferably comprises a reservoir chamber which is filled with tracer material prior to entry of the tool into the wellbore. The tracer ejection means is preferably controlled from the surface to release upon actuation a discrete slug of tracer material into the surrounding carrier fluid. A complete logging tool assembly typically further includes a magnetic casing collar locator for providing a means of depth referencing, and a gamma ray detector.

Of importance in the logging method of the present invention, as will become better understood, is knowledge of the distance of separation between the two slugs of tracer material. One way of ascertaining the distance between the two slugs of tracer material is to simultaneously eject a tracer slug from each of two locations separated by a known distance. Another way is to sequentially eject two slugs from one location. That is, one slug of tracer is ejected followed by ejection of another slug of tracer a short period of time later. The tool is, of course, held stationary. The tool is then lowered below the two slugs and moved upwardly therethrough. Signals resulting from detection of the two slugs of tracer material are produced and provided at the surface to suitable recording means, such as a strip chart recorder. The trace on the recorder is appropriately calibrated to indicate the initial distance of separation between the two tracer slugs.

After ejection of the tracer slugs, the method continues with the logging tool being lowered below the tracer slugs and the distance between them again being determined using the detector. Because of depth correlation information available from the tool, the depth of the tool within the wellbore is known. A complete injection profile of the wellbore is determined by monitoring the distance between the two tracer slugs as a function of depth as the slugs move down the wellbore. The injection profile is developed by calculating the amount of fluid exiting the wellbore, which calculation is based on the separation of the tracer slugs at particular depths in the borehole.

Figure 1:
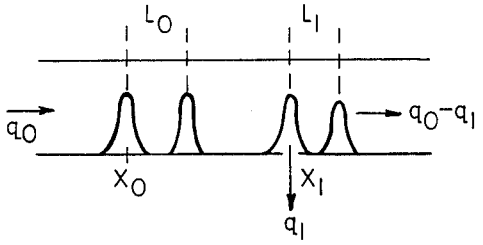
FIG. 1 is a diagram illustrative of the movement of two tracer slugs past a point of fluid exit from a wellbore.

In order to better understand the basis of the method, consider FIG. 1, which shows two slugs of tracer moving past a point of fluid exit from the wellbore. In order to relate the spacing between the tracer slugs after passing the fluid exit point, $\mathbf{1}_1$, to the amount of the fluid exiting, $q_1$, we first calculate the amount of time required for the back slug to reach $x_1$. The velocity V is defined as:

$$v = \frac{dx}{dt} = \frac{q}{A} \tag{1}$$

where q is the volumetric flow rate and A is the cross-sectional area of the wellbore. For the back slug to travel from $x_0$ to $x_1$, $$\frac{dx}{dt} = \frac{q_0}{A} \tag{2}$$

or, integrating $$\Delta t_b = \frac{A(x_1 - x_0)}{q_0} \tag{3}$$

where $\Delta t_b$ is the time required for the back slug to travel from $x_0$ to $x_1$. Now, during this same length of time, the front slug has travelled from $x_0+\mathbf{1}_0$ to $x_1+\mathbf{1}_1$. The transit time for the front slug can be broken into two parts; $\Delta t_1$, the time required to travel from $x_0+\mathbf{1}_0$ to $x_1$, and, $\Delta t_2$, the time required to travel from $x_1$ to $x_1+\mathbf{1}_1$. Analyzing these transit times, $\Delta t_1$:

$$\frac{dx}{dt} = \frac{q_0}{A} \tag{4}$$

$$\int_{x_0 + l_0}^{x_1} dx = \frac{q_0}{A}\Delta t_1 \tag{5}$$

or $$\Delta t_1 = \frac{A(x_1 - x_0 - l_0)}{q_0} \tag{6}$$

-continued $\Delta t_2$:

$$\frac{dx}{dt} = \frac{q_0 - q_1}{A} \tag{7}$$

$$\int_{x_1}^{x_1 + l_1} dx = \frac{q_0 - q_1}{A}\Delta t_2 \tag{8}$$

$$\Delta t_2 = \frac{l_1 A}{q_0 - q_1} \tag{9}$$

Now, equating the transit times $$\Delta t_b = \Delta t_1 + \Delta t_2 \tag{10}$$

or $$\frac{A(x_1 - x_0)}{q_0} = \frac{A(x_1 - x_0 - l_0)}{q_0} + \frac{l_1 A}{q_0 - q_1} \tag{11}$$

The cross-sectional area, A, cancels out, and $$\frac{l_1}{q_0 - q_1} = \frac{(x_1 - x_0) - (x_1 - x_0 - l_0)}{q_0} \tag{12}$$

so, $$l_1 = l_0 \frac{q_0 - q_1}{q_0} \tag{13}$$

which can be rewritten as $$q_i = q_o \frac{l_o - l_i}{l_o} \tag{13a}$$

This shows that the distance between the slugs of tracer is proportional to the amount of fluid exiting between the measurement locations. Therefore, repeated measurements, at different depths, of the distance of separation between two tracer slugs will yield through calculation with equation (13*a*) an injection profile of a well. The calculations can be made using any one of several calculating means. For example, a hand held calculator or a programmed personal computer may be satisfactorily used to make the calculations.

If the cross-sectional areas at the measurement locations differ, it can be readily shown that equation 13 is modified to $$\frac{A_0 l_0 (q_0 - q_1)}{A_1 q_0} \tag{14}$$

which can be rewritten as $$q_i = q_o \frac{A_o l_o - A_i l_i}{A_o l_o} \tag{14a}$$

where $A_0$ and $A_1$ are the cross-sectional areas at the locations $X_0$ and $X_1$, respectively. The cross-sectional area of the wellbore as a function of depth can be determined with conventional logging methods, such as caliper logging, for the purpose of this method. Those knowledgeable in the art will recognize that the method is not affected by cross-sectional area variations between measurement locations and that only the cross-sectional areas at the measurement location need be considered.

Figure 2:
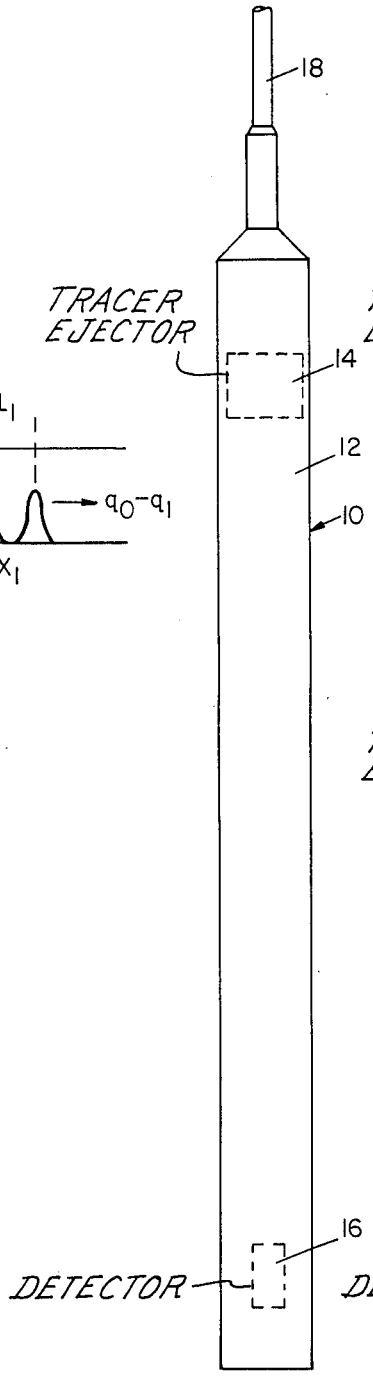
FIG. 2 is a diagram of a single ejector tracer injection logging device for conducting the two-pulse tracer injection method.

Referring now to FIG. 2, there is shown a conventional logging tool 10 for use in conducting the method of the present invention. Tool 10 includes a housing 12 having a tracer ejector mechanism 14 and a radiation detector 16. The tool is supported in a wellbore by cable 18. Logging tool 10 is of a conventional design such as that available from SIE Geosource Wireline Products Division, 7450 Winscott Rd., Ft. Worth, Tex. 76126.

Figure 3:
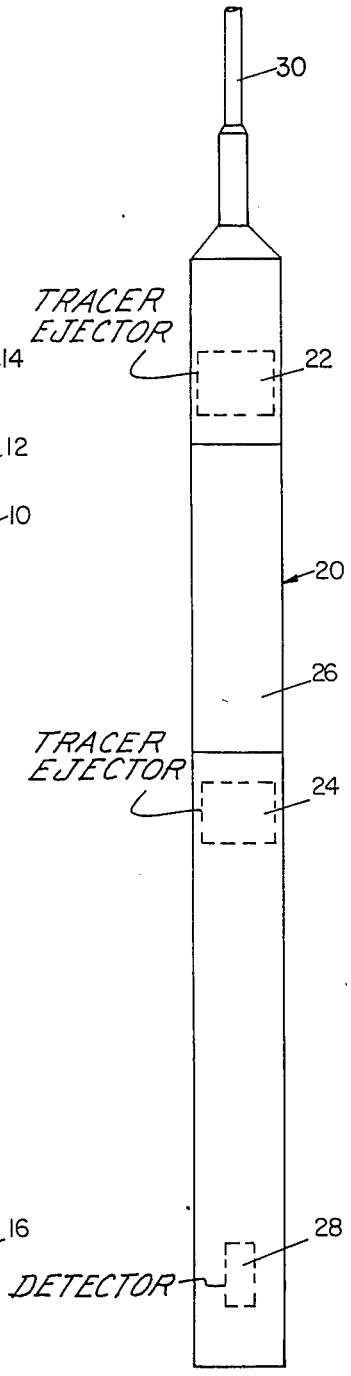
FIG. 3 is a diagram of a dual ejector tracer injection logging device for conducting the two-pulse tracer injection method.

Alternatively, and with reference to FIG. 3, the method of the present invention can be conducted using logging tool 20. This tool includes first and second tracer ejector mechanisms 22 and 24, which are separated a known distance. Both the tracer mechanisms are mounted in a housing 26. A radiation detector 28 is further included. Both tracer ejector mechanisms 22 and 24 are of conventional design and suitably correspond to the tracer ejector mechanism 14 in tool 10 shown in FIG. 2.

The foregoing description of the invention has been directed to particular preferred embodiments for purposes of explanation and illustration. It will be apparent, however, to those skilled in this art that modifications and changes in both method and apparatus may be made without departing from the essence of the invention. For example, although the preferred method and apparatus employs a radioactive tracer, any other tracer material that can be dispersed in the carrier fluid and remotely detected would be suitable for this invention. Other possible tracers and detection means include tiny bubbles or droplets of an immiscible gas or liquid that could be detected by, for example an ultrasonic probe; and a soluble ion, such as, for example, ammonium, that could be detected with a specific ion electrode. It is the applicant's intention of the following claims to cover all equivalent modifications and variations as fall within the scope of the invention.

What is claimed is:

1. A method of tracer logging to determine the injection profile of a well, comprising the steps of:

injecting a first slug of tracer material into a carrier fluid at a location above any point of fluid exit from a wellbore;

injecting a second slug of tracer material into the carrier fluid so as to be a known distance from the first tracer slug;

moving a tracer material detector through the slugs to determine the distance between the two tracer slugs at a known depth in the wellbore; and calculating the amount of fluid exiting the wellbore based upon the distance determination.

2. The method of claim 1 wherein the amount of exiting fluid is calculated using the equation:

$$q_1 = q_0 \frac{l_0 - l_1}{l_0}$$

where $q_1$ is the volumetric flow rate of fluid exiting above the known depth of measurement at $l_1$;

$q_0$ the volumetric flow rate of carrier fluid introduced into the wellbore;

$l_0$ is the known distance of separation between the tracer slugs at injection into the carrier fluid; and $l_1$ is the determined distance of separation between the tracer slugs at the known depth in the wellbore.

3. The method of claim 2 wherein the first and second tracer slugs are simultaneously injected into the carrier fluid from a logging tool having two tracer ejector devices separated a predetermined distance apart.

4. The method of claim 2 wherein the first and second tracer slugs are sequentially injected into the carrier fluid from a logging tool having a single tracer ejector device.

5. The method of claim 1 wherein the first and second tracer slugs are simultaneously injected into the carrier fluid from a logging tool having two tracer ejector devices separated a predetermined distance apart.

6. The method of claim 1 wherein the first and second tracer slugs are sequentially injected into the carrier fluid from a logging tool having a single tracer ejector device.

7. A method of tracer logging to determine the injection profile of a well, comprising the steps of:

injecting first and second slugs of tracer material into a carrier fluid at a location above any point of fluid exit from a wellbore;

said second slug of tracer material being injected into the carrier fluid so as to be a known distance from the first tracer slug;

moving a tracer material detector through the slugs to determine the distance between the two tracer slugs at a known depth in the wellbore; and calculating the amount of fluid exiting the wellbore based upon the distance determination.

8. The method of claim 7 wherein the amount of exiting fluid is calculated using the equation:

$$q_1 = q_0 \frac{A_0 l_0 - A_1 l_1}{A_0 l_0}$$

where $q_1$ is the volumetric flow rate of fluid exiting above the known depth of measurement at $l_1$;

$q_0$ the volumetric flow rate of carrier fluid introduced into the wellbore;

$l_0$ is the known distance of separation between the tracer slugs at injection into the carrier fluid;

$l_1$ is the determined distance of separation between the tracer slugs at the known depth in the wellbore;

$A_0$ is the cross-sectional area of the wellbore at the depth location where the tracer slugs are injected into the carrier fluid; and $A_1$ is the cross-sectional area of the wellbore at the depth location where the distance between the two tracer slugs is determined.

9. A method of tracer logging to determine the injection profile of a well, comprising the steps of:

introducing a carrier-fluid into a wellbore to flow down therethrough;

injecting a first slug of tracer material into the carrier fluid;

injecting a second slug of tracer material into the carrier fluid;

said first and second tracer slugs being injected into the carrier fluid at a point above any point of fluid exit from the wellbore;

moving a tracer detector device through the slugs of tracer to determine the initial spacing therebetween;

repeatedly moving the detector device through the slugs of tracer to determine the spacing therebetween as a function of depth in the wellbore; and calculating the amount of fluid exiting the wellbore as a function of depth.

10. The method of claim 9 wherein the amount of exiting fluid is calculated using the equation:

$$q_1 = q_0 \frac{l_0 - l_1}{l_0}$$

where $q_1$ is the volumetric flow rate of exiting fluid above the known depth of measurement of $l_1$;

$q_0$ is the volumetric flow rate of carrier fluid introduced into the wellbore;

$l_0$ is the initial distance of separation between the tracer slugs; and $l_1$ is the determined distance of separation between the tracer slugs at a known depth in the wellbore.

* * * * *